US005577634A

United States Patent [19]

Morand

[11] Patent Number: 5,577,634

[45] Date of Patent: Nov. 26, 1996

[54] PAPER TOWEL DISPENSER FOR DISPENSING TOWELLING FROM INSIDE DIAMETER OF ROLL

[75] Inventor: Michel Morand, Montreal, Canada

[73] Assignee: G. H. Wood & Wyant, Inc., Quebec, Canada

[21] Appl. No.: 441,461

[22] Filed: May 15, 1995

[30] Foreign Application Priority Data

Jun. 16, 1994 [GB] United Kingdom ..... 9412076

[51] Int. Cl.[6] ..... B65H 3/00

[52] U.S. Cl. ..... 221/43; 221/63; 221/33

[58] Field of Search ..... 221/26, 33, 36, 221/42, 43, 63; 242/615.2, 615.3, 593; 225/106

[56] References Cited

U.S. PATENT DOCUMENTS 4,171,047 10/1979 Doyle et al. ..... 221/63
5,141,171 8/1992 Yang .
5,205,455 4/1993 Moody .
5,211,308 5/1993 Decker et al. .
5,215,211 6/1993 Eberle .
5,310,083 5/1994 Rizzuto ..... 221/63

*Primary Examiner*—H. Grant Skaggs
*Attorney, Agent, or Firm*—Larson and Taylor

[57] ABSTRACT

A dispenser for dispensing sheets of paper towelling from a tubular roll of paper towelling that has perforated lines across it at spaced-apart intervals dividing the towelling into joined together sheets. The dispenser has a base on which one end of the towelling roll sits and an opening in the base through which one end of the towelling, from within the roll, is passed in the form of a spiral tail. This tail is then passed through gripping members beneath the base which both flatten the towel into a band-like strip and grip the strip so that when the strip is pulled beneath the gripping means, the outermost sheet of towelling is torn away along a line of perforations.

11 Claims, 3 Drawing Sheets

PAPER TOWEL DISPENSER FOR DISPENSING TOWELLING FROM INSIDE DIAMETER OF ROLL

FILED OF THE INVENTION

This invention is directed toward an improved dispenser for dispensing paper towelling.

The invention is more particularly directed toward an improved dispenser of the type that dispenses sheets of towelling from a tubular roll of towelling. The roll rests on one end of the dispenser with the towelling being drawn off from the interior of the roll.

BACKGROUND OF THE INVENTION

Dispensers which dispense towelling from the interior of a roll usually have a central opening through which the towelling is passed. This opening is usually round, is usually on the bottom of the dispenser, and forms the towelling into a rope like, spiral form. The rope like form of towelling is difficult to handle. Towelling in this form is very strong and requires great effort to tear it off into a sheet. When a person's hands are wet, a strong pull on the towelling can cause it to disintegrate. In addition, a strong pull on the rope like form of towelling may cause it to tear unevenly, even though lines of perforations are usually provided in the towelling.

The known dispensers with a bottom, central opening have an additional disadvantage in that it is awkward and even difficult to thread the free end of the towelling through the opening when installing a new roll of towelling. The janitor must twist the end of the towelling into a tight tail and hold it in this position while trying to pass it through the opening and at the same time, supporting the roll.

The towelling in the known dispensers also sometimes becomes torn within the dispenser because Of the uneven tearing action. It is difficult, if not impossible to reach within the opening to grasp the end of the towelling inside the dispenser and often the janitor must be called to open up the dispenser and re-thread towelling.

SUMMARY OF THE INVENTION

It is the purpose of the present invention to provide an improved dispenser that makes it easier to dispense towelling from the interior of a roll of towelling. It is a further purpose of the present invention to provide an improved dispenser that makes it easier to dispense the towelling in individual sheets. It is another purpose of the present invention to provide an improved dispenser that makes it easier to initially start dispensing the towelling when installing a new roll in the dispenser.

In accordance with the present invention there is provided an improved dispenser having a base with a bottom opening. The roll of towelling is adapted to be supported by one end on the base as is known with the end of the towelling passed through the opening from the interior of the roll. The opening is larger than normal so that the towelling passes easily through it. The end of the towelling forms a spiral, rope-like tail as it passes through the opening. In accordance with the present invention a pair of small rollers are provided beneath the opening between which the tail is passed to flatten the tail so that it can be dispensed in an orderly manner. This band-like tail portion is easy to grasp and pull. More importantly, the band-like tail tears easily when pulled since the lines of perforations in the towelling are formed in a zig-zag fashion when the tail is flattened thereby facilitating tearing.

Preferably the rollers are spring biased towards each other to maintain contact thereby making it easier to dispense the towelling from the dispenser. The initial tearing begins automatically just below the rollers along the top point of each perforation line and continues down along the line as the towel is pulled out. Since the line zig-zags downwardly, this tearing action ensures that a portion of the towelling is always located below the rollers after a sheet has been torn off.

In accordance with the invention, means are provided for rotating at least one of the rollers to assist in initially feeding the end of the towelling out of the dispenser between the rollers. When the roll is initially installed the janitor need only take the end of the towelling and place it between the rollers. One of the rollers is then rotated to feed the towelling between the rollers to provide a band-like tail beneath the rollers. The roller rotating means can comprise a rack and pinion arrangement with the pinion selectively mounted for rotation on the shaft of the one roller and the rack movable from outside the dispenser. Moving the rack in one direction will clutch the pinion onto the roller shaft while rotating the pinion and thus the one roller. Movement of the rack in the other direction will de-clutch the pinion from the shaft;

The invention is particularly directed toward an improved dispenser for dispensing sheets of paper towelling from a tubular roll of paper towelling, the towelling having perforated lines across it at spaced-apart intervals dividing the towelling into joined sheets. The dispenser has a base on which one end of the roll of towelling sits. There is an opening in the base through which one end of the towelling, in the form of a spiral tail, is adapted to be passed from the interior of the roll on the base. Gripping means are provided on the base, beneath the opening, through which the spiral tail of the towelling is passed. The gripping means both flattens the spiral tail into a band-like tail and grips it sufficiently to allow the outermost sheet of towelling to be torn away from the remainder of the towelling along a perforated line, past the gripping means, when the band-like tail is pulled.

BRIEF DESCRIPTION OF THE DRAWINGS

The invention will now be described in detail having reference to the accompanying drawings in which.

DETAILED DESCRIPTION OF THE PREFERRED EMBODIMENT

Figure 1:
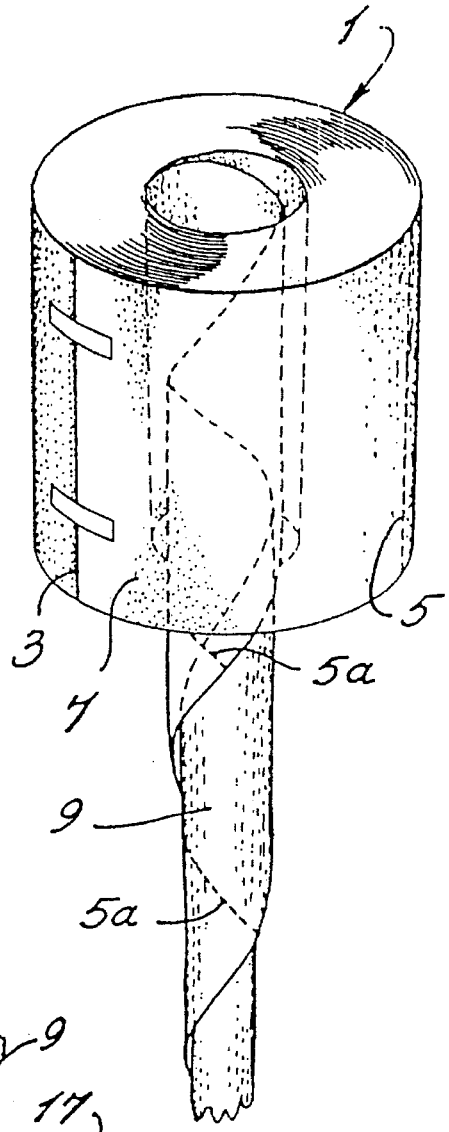
FIG. 1 is a perspective view of a roll of towelling used with the improved dispenser.

The dispenser of the present invention is adapted to be used with a tubular roll 1 of paper towelling 3 as shown in FIG. 1. The towelling 3 has spaced-apart lines of perforations 5 across it so it can be torn into sheets 7. The towelling 3 is fed from the roll from the interior of the roll in the form of a spiral tail 9. The lines of perforations 5*a* in the tail are at an angle as shown in FIG. 1.

Figure 2:
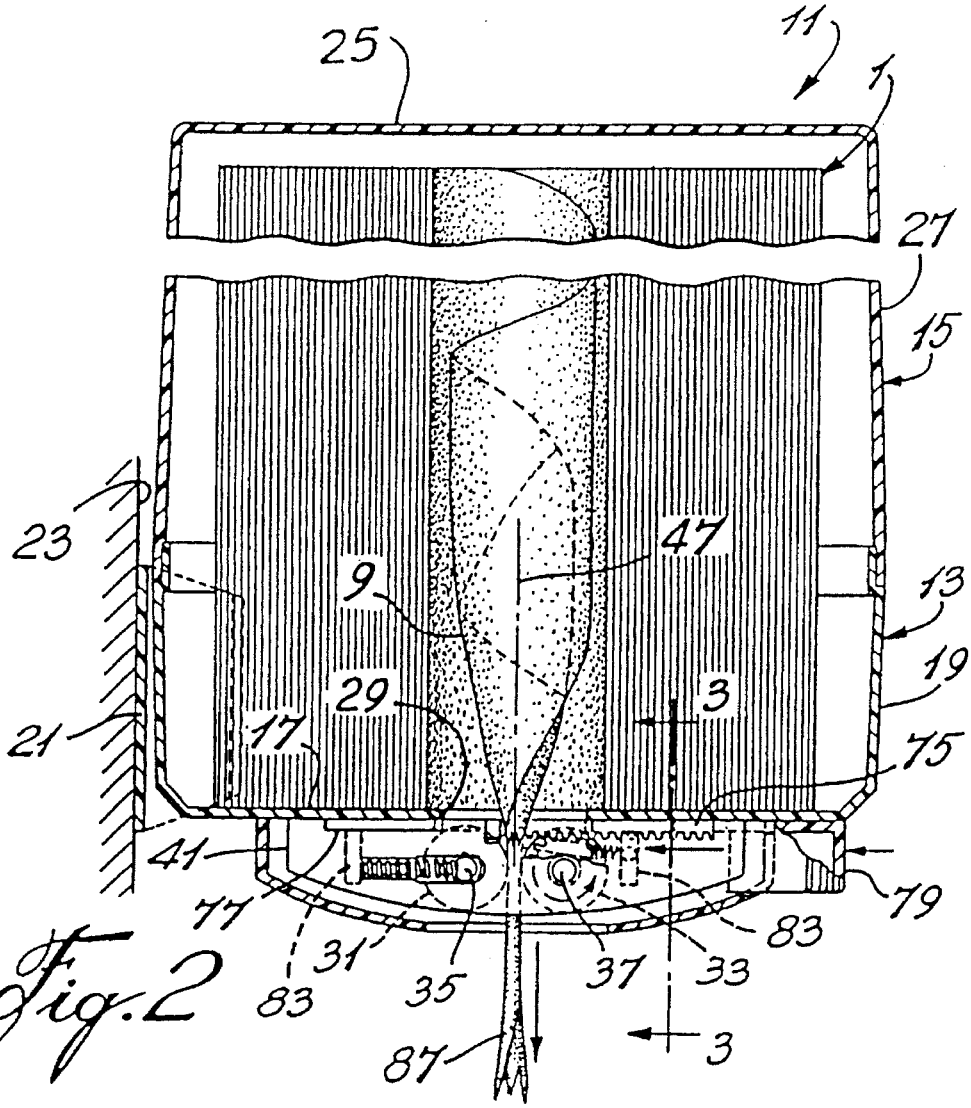
FIG. 2 is a vertical cross-section view of the dispenser.

The dispenser 11 for holding the roll 1 has, as shown FIG. 2, a base 13 and a cover 15. The base 13 has a circular bottom wall 17 and a short side wall 19. A mounting bracket 21, integral with the base 13, projects from the back of the side wall 19 for use in mounting the dispenser on a vertical surface 23. The cover 15 has a circular top 25 and a long side wall 27. The cover 15 is adapted to be mounted on, and locked to, the top of the base 13 by suitable means (not Shown). The base 13 has a central opening 29 in the bottom wall 17 through which the towelling is passed.

Figure 3:
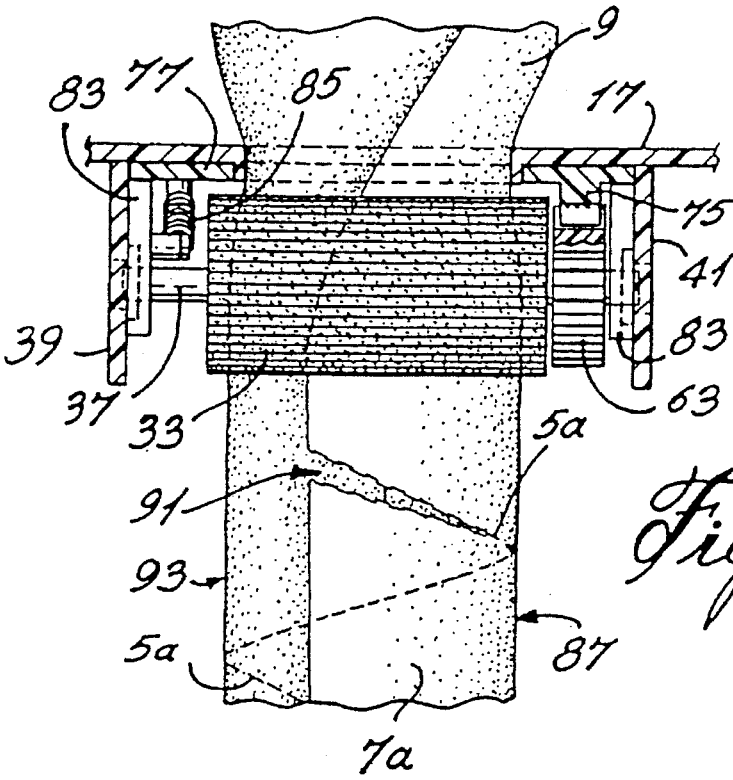
FIG. 3 is a cross-section view taken along line 3—3 of FIG. 2.
Figure 4:
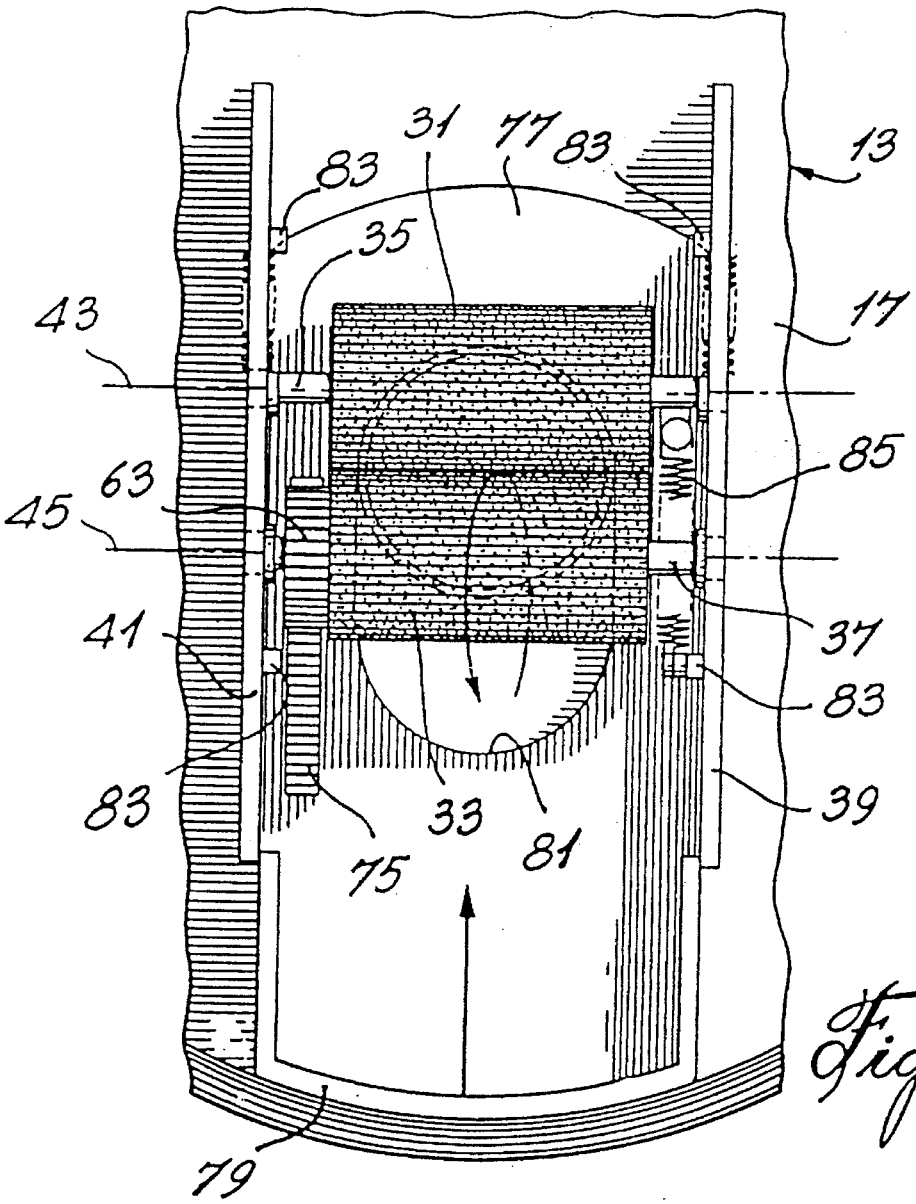
FIG. 4 is a bottom detail view of the dispenser.

A pair of rollers 31, 33 are mounted on the base 13 beneath the opening 29 as shown in FIGS. 2 to 4. The rollers 31, 33 are rotatably mounted by their shafts 35, 37 between two spaced apart, parallel side walls 39, 41 extending down from the bottom of the bottom wall 17 of the base 13. The rollers 31, 33 are parallel with their axis 43, 45 extending transverse to the vertical axis 47 of the opening 29 in the base 13. The rollers, 31, 33 are close together and preferably abut. The rollers are preferably made from resilient material such as rubber, and can have ridged surfaces.

Figure 5:
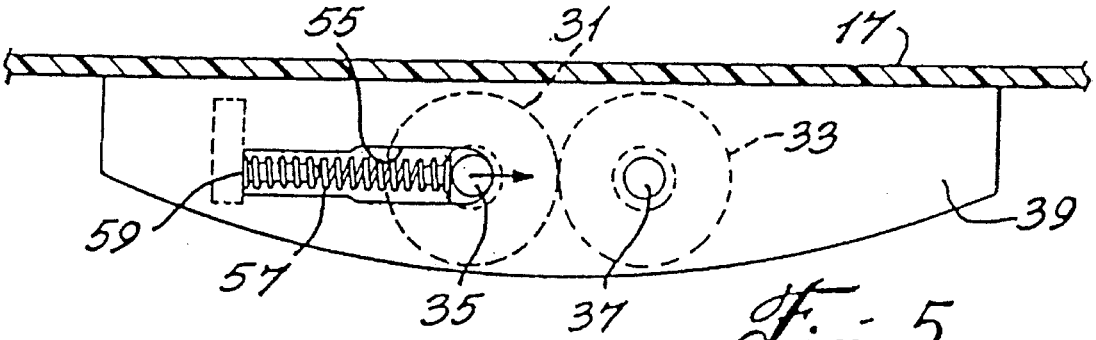
FIG. 5 is a detail side view of the bottom of the dispenser.

Means can be provided for ensuring that the rollers 31, 33 abut. These means can comprise a pair of springs mounted between the ends of the shaft 35 of roller 31 and the side walls 39, 41 as shown in FIG. 5. A slot 55 is provided on each side wall 39, 41. The ends of the shaft 35 are mounted in the slots 55. A compression spring 57 is mounted in each slot 55 between one end 59 of the slot 55 and the end of the shaft 35. The springs 57 bias the roller 31 against the roller 33.

Figure 6:
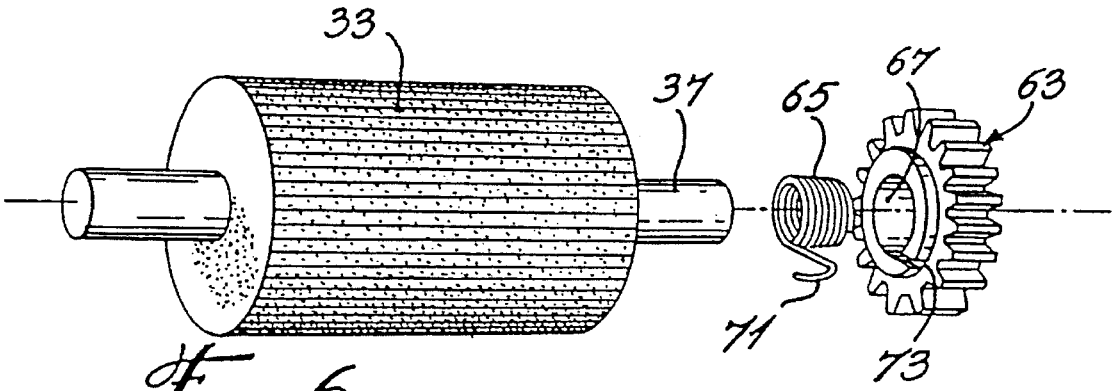
FIG. 6 is an exploded perspective view of one of the rollers and the clutch and pinion gear associated with it.

Preferably means are provided for selectively rotating roller 33. These means can comprise a rack and pinion arrangement that is mounted on the base 13. The pinion comprises a gear 63 mounted adjacent the roller 33 on its shaft 37 as shown in FIGS. 3 and 4. A simple clutch in the form of a spring 65 selectively connects the gear 63 to the shaft 37 as shown in FIG. 6. The spring 65 is located in the hub 67 of the gear 63 so as to be between the shaft 37 and the gear 63. One end 71 of the spring 65 is inserted in an opening 73 in the side of the pinion gear 63. Rotation of the gear 63 in one direction will wrap the spring 65 tightly about the shaft 37 causing the shaft to rotate with the gear. Rotation of the gear 63 in the opposite direction will loosen the spring on the shaft 37 permitting the gear to rotate without rotating the shaft.

The rack 75 is mounted on the bottom of a pusher plate 77 as shown in FIGS. 3 and 4. The pusher plate 77 has a handle 79 at one end and is slidably mounted between the side walls 39, 41 and adjacent the bottom wall 17 of the base 13. There is an elongated central opening 81 in the plate through which the tail of the towelling passes. The plate 77 is supported for sliding movement on four projections 83, two on each side wall 39, 41 which projections extend inwardly from the side walls. A tension spring 85 is mounted between the pusher plate 77 and side wall 39, the spring 85 extending generally parallel to the side wall. At rest, the handle 79 of the pusher plate 77 is generally aligned with the outer edge of the dispenser as shown in FIG. 2. Pushing the handle 79 inwardly against the resistance of the spring 85 will cause the rack 75 to rotate the gear 63. The spring 65 will clutch the gear 63 to the shaft 37 causing the roller 33 to rotate as well. Releasing the handle 79 causes the spring 85 to return the handle 79. When the handle 79 returns, the spring 65 is de-clutched from the shaft 37 so that the roller 33 does not rotate in the opposite direction. Cooperating stop means (not shown) can be provided on the plate 77 and base 13 to limit the return movement of the plate 77.

In use, the cover 15 of the dispenser is removed and a roll 1 of towelling is positioned over the base 13. A tail 9 of towelling is drawn out from the interior of the roll and passed through the opening 29 in the base 13 to rest between the rollers 31, 33. The pusher plate 77 is then pushed inwardly to rotate the roller 33 and roller 31 in a direction causing it to draw the tail 9 down between the rollers 31, 33. As the tail 9 is drawn between the rollers it is flattened in a band 87 as shown in FIG. 2 and 3. Once the tail is loaded between the rollers, the pusher plate is released and it returns to its start position but without rotating the rollers. With the tail now loaded, the roll of towelling is placed on the base 13, sitting on one end on the bottom wall 17, and the cover 15 is mounted and locked onto the base 13.

When the band 87 of towelling is pulled downwardly from the base 13, by the user of the dispenser, the rollers 31, 33 rotate but grip the band tightly enough between them so that the sheet of towelling starts to tear after the line of perforations 5*a* has passed the rollers. The lines of perforations in the flattened band 87 are at an angle as shown in FIG. 3. As the towelling is pulled down tension builds up in the web of the towelling and tearing starts at the top of the line of perforations, as shown at 91 in FIG. 3, just below the rollers, and moves diagonally downwardly across the band as pulling continues until the leading sheet 7*a* is severed from the towelling. Because the tearing always starts below the rollers and continues downwardly, there is always a portion 93 of the towelling left below the rollers 31, 33 after the leading sheet is torn off to provide access for dispensing the next sheet.

If for some reason, the towelling tears above the rollers it is possible for the user to re-thread the towelling between the rollers by pushing the handle 79 in one or more times.

The base of the dispenser is preferably made of transparent material so that a janitor could look up from the bottom to see if the dispenser needs servicing.

I claim:

1. A dispenser for dispensing sheets of paper towelling from a tubular roll of paper towelling, the towelling having perforated lines across it at spaced-apart intervals dividing the towelling into joined sheets, the dispenser having:

a base on which one end of the roll of towelling sits;

an opening in the base through which one end of the towelling in the form of a spiral tail, is adapted to be passed from the interior of the roll on the base; and gripping means on the base, beneath the opening, through which the spiral tail of the towelling is passed, the gripping means for both flattening the spiral tail into a band-like tail and for positively gripping it sufficiently to allow the outermost sheet of towelling to be torn away from the remainder of the towelling along a perforated line, past the gripping means, when the band-like tail is pulled.

2. A dispenser as claimed in claim 1 wherein the gripping means comprises a pair of side-by-side rollers mounted on the base beneath the opening, the rollers being freely rotatable, the axis of the rollers being generally transverse to the axis of the opening in the base of the dispenser, the spiral tail passing between the rollers.

3. A dispenser as claimed in claim 2 wherein the rollers are made from resilient material.

4. A dispenser as claimed in claim 2 including biasing means for ensuring that the rollers abut.

5. A dispenser as claimed in claim 4 wherein the biasing means comprise springs on the base, biasing one roller toward the other.

6. A dispenser as claimed in claim 2 including rotating means for selectively rotating one of the rollers.

7. A dispenser as claimed in claim 6 wherein the rotating means comprises: a pinion gear; a shaft on the one roller with the pinion gear rotatably mounted on the shaft adjacent the one roller; a clutch selectively connecting the pinion gear to the shaft for rotating the shaft and thus the roller when the gear rotates in one direction; and a pusher member mounted for sliding movement relative to the base, the pusher member carrying a rack that meshes with the pinion whereby when the pusher member is pushed in one direction it will, through the rack, rotate the one roller in one direction.

8. A dispenser as claimed in claim 7 wherein the pusher member comprises a plate slidably mounted on the base parallel to the base located beneath it, the plate having an elongated opening aligned with the opening in the base.

9. A dispenser as claimed in claim 8 wherein the clutch connects the pinion gear to the shaft when the pusher member slides in one direction from a start position to feed the spiral tail of the towelling through the rollers, and disconnects the pinion gear from the shaft when the pusher member slides in the other direction to return to the start position.

10. A dispenser as claimed in claim 9 including resilient means biasing the pusher member to the start position.

11. A dispenser as claimed in claim 2 wherein the gripping means is movable to flatten the spiral tail of the towelling while positively gripping the spiral tail.

* * * * *